US006685462B2

(12) United States Patent
Jones et al.

(10) Patent No.: US 6,685,462 B2
(45) Date of Patent: Feb. 3, 2004

(54) APPARATUS FOR BURNING FUEL WITH LOW NOX FORMATION

(75) Inventors: Andrew P. Jones, Winfield, KS (US); Danny L. Christenson, Mulvane, KS (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 10/397,642

(22) Filed: Mar. 26, 2003

(65) Prior Publication Data

US 2003/0190570 A1 Oct. 9, 2003

Related U.S. Application Data

(62) Division of application No. 09/888,835, filed on Jun. 25, 2001, now Pat. No. 6,565,361.

(51) Int. Cl.[7] ..... F23C 5/00; F23M 3/00; F23M 9/00

(52) U.S. Cl. ..... 431/8; 431/9; 431/115; 431/188

(58) Field of Search ..... 431/8, 9, 174, 431/181, 187, 188, 115, 116

(56) References Cited

U.S. PATENT DOCUMENTS

| | | | |
|---|---|---|---|
| 4,945,841 | A | 8/1990 | Nakamachi et al. |
| 5,098,282 | A | 3/1992 | Schwartz et al. |
| 5,147,200 | A | 9/1992 | Knöpfel et al. |
| 5,195,884 | A | 3/1993 | Schwartz et al. |
| 5,201,650 | A | 4/1993 | Johnson |
| 5,238,395 | A | 8/1993 | Schwartz et al. |
| 5,407,345 | A | 4/1995 | Robertson et al. |
| 5,554,021 | A | 9/1996 | Robertson et al. |
| 5,605,452 | A | 2/1997 | Robertson et al. |
| 5,667,376 | A | 9/1997 | Robertson et al. |
| 5,730,591 | A | 3/1998 | Robertson et al. |
| 5,797,738 | A | 8/1998 | Wills |

*Primary Examiner*—Alfred Basichas
(74) *Attorney, Agent, or Firm*—McAfee & Taft

(57) ABSTRACT

Improved apparatus for burning fuel with low $NO_x$ formation are provided. An apparatus of the invention for discharging a mixture of fuel gas and air into a furnace wherein the mixture is burned and flue gases having a low $NO_x$ content are formed includes the following. A burner housing, attached to a furnace, is provided having a means for mixing a first portion of the fuel gas with a first portion of the air to form a primary fuel gas-air mixture and discharging the primary fuel gas-air mixture into a primary burning zone in the furnace from at least one discharge location surrounded by a wall which extends into the furnace. A means for mixing a second portion of the fuel with a second portion of the air to form a secondary fuel gas-air mixture is also provided whereby the secondary fuel gas-air mixture is discharged into a secondary burning zone in the furnace from at least one discharge location adjacent to an exterior side of the wall. The present invention means for discharging the secondary fuel gas-air mixture causes it to discharge at a velocity whereby the secondary fuel gas-air mixture is not ignited and burned until the mixture spreads over an exterior side of the wall, mixes with flue gases in the furnace and flows beyond the wall.

15 Claims, 4 Drawing Sheets

APPARATUS FOR BURNING FUEL WITH LOW NOX FORMATION

This Application is a Division of application Ser. No. 09/888,835 filed on Jun. 25, 2001 now U.S. Pat. No. 6,565,361.

BACKGROUND OF THE INVENTION

1. Field of the Invention.

The present invention relates to improved burner apparatus for burning fuel gas-air mixtures whereby flue gases having low $NO_x$ content are produced.

2. Description of the Prior Art.

The environmental emission standards imposed by governmental authorities are continuously becoming more stringent. Such standards limit the quantities of gaseous pollutants such as nitrogen oxides ($NO_x$) and carbon monoxide which can be emitted into the atmosphere. As a result of the standards, improved burner designs have been developed which lower the production of $NO_x$ and other polluting gases. For example, methods and apparatus wherein fuel is burned in less than a stoichiometric concentration of oxygen to intentionally produce a reducing environment of carbon monoxide and hydrogen have been proposed. This concept has been utilized in staged air burner apparatus wherein the fuel is burned in a deficiency of air in a first zone producing a reducing environment that suppresses $NO_x$ formation and the remaining portion of air is introduced into a second zone.

Methods and apparatus have also been developed wherein all of the air and some of the fuel is burned in a first zone and the remaining fuel is burned in a second zone. In this staged fuel approach, an excess of air in the first zone acts as a diluent which lowers the temperature of the burning gases and thereby reduces the formation of $NO_x$. Other methods and apparatus have been developed wherein flue gases are combined with fuel gas-air mixtures to dilute the mixtures and lower their combustion temperatures and the formation of $NO_x$.

While the prior art methods and burner apparatus for producing flue gases having low $NO_x$ contents have achieved varying degrees of success, needs still remain for improvement in gas burner apparatus and methods of burning fuel gas whereby simple economical burner apparatus is utilized and lower $NO_x$ content flue gases are produced.

SUMMARY OF THE INVENTION

The present invention provides improved methods and burner apparatus for burning fuel gas-air mixtures with low $NO_x$ formation which meet the above described needs and overcome the deficiencies of the prior art. An improved method of this invention for discharging a mixture of fuel gas and air into a furnace wherein the mixture is burned and flue gases having a low $NO_x$ content are formed therefrom is basically comprised of the following steps. A first portion of the fuel gas is mixed with a first portion of the air to form a primary fuel gas-air mixture. The primary fuel gas-air mixture is discharged into a primary burning zone in the furnace from at least one discharge location surrounded by a wall which extends into the furnace. A second portion of the fuel gas and a second portion of the air are mixed to form a secondary fuel gas-air mixture. The secondary fuel gas-air mixture is discharged into a secondary burning zone in the furnace from at least one discharge location adjacent to an exterior side of the wall. The secondary fuel gas-air mixture is discharged at a velocity whereby the mixture is not ignited and burned until after the mixture spreads over the exterior side of the wall, mixes with flue gases in the furnace and flows beyond the wall.

An improved burner apparatus of this invention for discharging a mixture of fuel gas and air into a furnace wherein the mixture is burned and flue gases having low $NO_x$ content are formed includes a housing having a forward end which is attached to an opening in the furnace. The forward end of the housing includes a base portion and a wall portion which extends into the furnace. The wall portion surrounds a central area of the base portion. Means are connected to the housing for mixing a first portion of the fuel gas with a first portion of the air to form a primary fuel gas-air mixture and discharging the mixture into a primary burning zone in the furnace from at least one discharge location within the space defined by the central area of the base portion and the interior of the wall portion of the burner housing. Additional means are connected to the housing for mixing a second portion of the fuel gas with a second portion of the air to form a secondary fuel gas-air mixture and discharging the secondary fuel gas-air mixture into a secondary burning zone in the furnace from at least one discharge location adjacent to an exterior side of the wall portion of the burner housing. The secondary fuel gas-air mixture is discharged at a velocity whereby the mixture is not ignited and burned until after the mixture spreads over the exterior side of the wall portion, mixes with flue gases in the furnace and flows beyond the wall portion. In a preferred embodiment, the exterior sides of the wall portion of the housing slant towards the central area of the base portion.

It is, therefore, a general object of the present invention to provide improved methods and burner apparatus for burning fuel with low $NO_x$ formation.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a partially schematic side cross-sectional view which is similar to FIG. 5 and includes the same reference numerals which designate the same parts, but which also includes additional parts which are designated by additional numerals.

DESCRIPTION OF PREFERRED EMBODIMENTS

Figure 1:
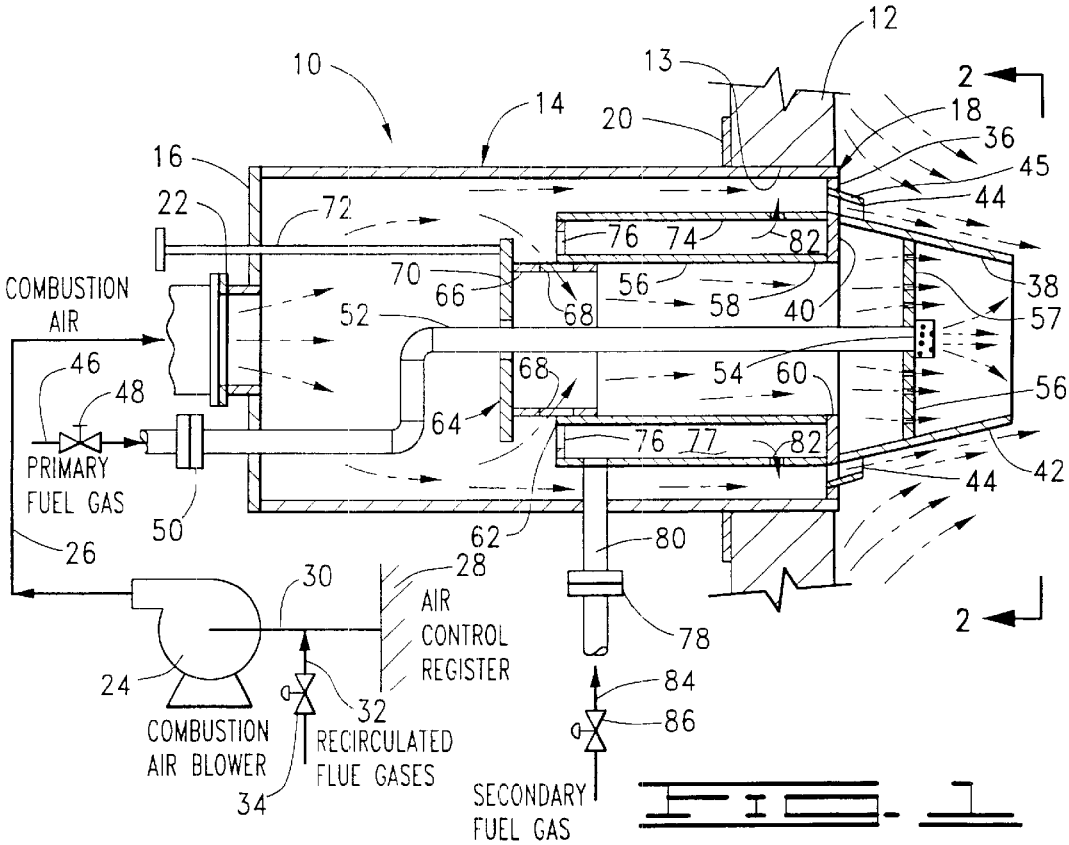
FIG. 1 is a partially schematic side cross-sectional view of one form of the burner apparatus of the present invention attached to a furnace wall.
Figure 2:
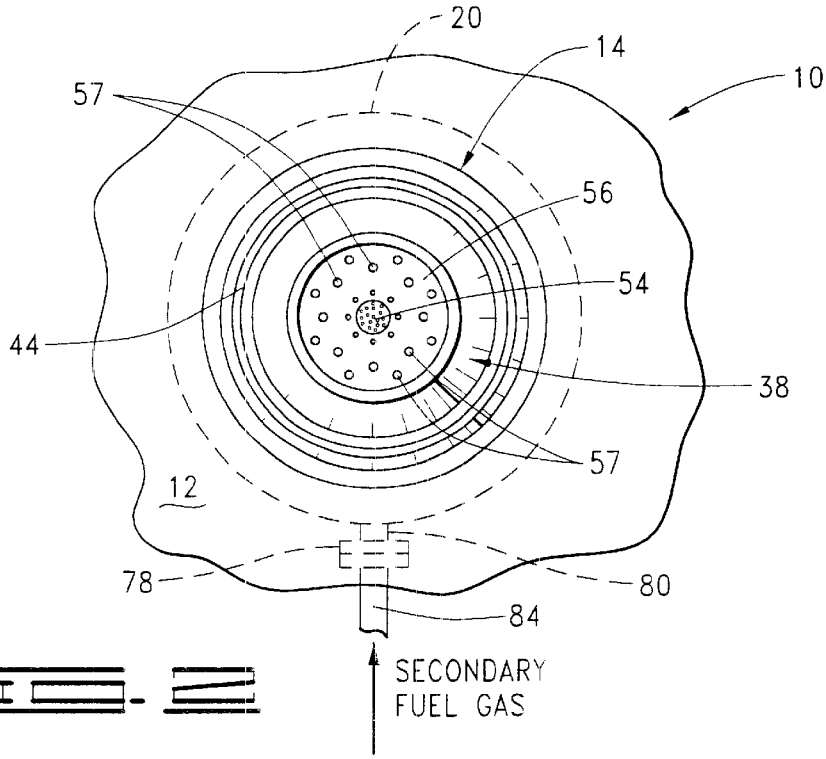
FIG. 2 is a view taken along line 2—2 of FIG. 1.

Referring now to the drawings, and particularly to FIGS. 1 and 2, a low $NO_x$ formation burner apparatus of the present invention is illustrated and generally designated by the numeral 10. The burner apparatus 10 is sealingly attached to a side wall 12 of a furnace over and in an opening 13 therein. As will be understood by those skilled in the art, gas burner apparatus can be mounted vertically, horizontally or at angles without affecting the burner operation. Gas burner apparatus are commonly mounted to side walls of steam boilers and to bottom walls of process heaters.

The burner apparatus 10 is comprised of a preferably cylindrical housing 14 having a closed rearward or exterior end 16 and a substantially closed interior or forward end 18. The housing 14 is attached to the outside of the furnace wall 12 by a flange 20 attached to the housing 14 and a plurality of bolts or the like (not shown). A combustion air inlet connection 22 is attached to the rearward end 16 of the housing 14 and the discharge of a conventional combustion air blower 24 is connected to the connection 22 by a conduit 26. The air inlet of the air blower 24 is connected to an air control register 28 by a conduit or plenum 30. A conduit 32 having a flow control valve 34 disposed therein is connected to the conduit or plenum 30 at one end and to a flue gases outlet connection (not shown) attached to the furnace to which the burner apparatus 10 is attached or to a stack connected to the furnace or to another source of flue gases. A portion of the flue gases can be recirculated to the combustion air blower by way of the conduit 32, the valve 34 and the conduit or plenum 30 whereby the flue gases are mixed with the combustion air.

The forward end 18 of the housing 14 includes a base portion 36 and a wall portion 38. The wall portion 38 extends into the furnace to which the burner apparatus 10 is attached and surrounds a central area 40 of the base portion 36. The exterior side 42 of the wall portion 38 preferably slants toward the central area 40 of the base portion 36. Most preferably, the wall portion 38 has the overall form of a truncated cone as is best shown in FIG. 1.

The base portion 36 outside the wall portion 38 includes at least one opening 44 positioned adjacent to an exterior side 42 of the wall portion 38. Preferably, the base portion 36 includes a plurality of openings 44 spaced around and adjacent to the exterior side 42 of the wall portion 38 or a continuous arcuate opening 44 which surrounds the exterior side 42 of the wall portion 38. The opening or openings 44 preferably include a deflector 45 which functions to direct the discharged secondary fuel gas-air mixture whereby it flows along and spreads over the exterior side 42 of the wall portion 38.

Primary fuel gas is conducted to the burner apparatus 10 by a conduit 46 having a flow control valve 48 disposed therein. The conduit 46 is attached to a primary fuel gas inlet connection 50 of the burner apparatus 10 which is in turn connected to a primary fuel gas conduit 52 disposed within the housing 14 of the burner apparatus 10. The conduit 52 conducts the primary fuel gas to a primary fuel gas discharge nozzle 54 disposed centrally within the inside of the wall portion 38 of the forward end 18 of the housing 14. The conduit 52 and the discharge nozzle 54 are centrally supported within the wall portion 38 by a flame retention plate 56. As will be understood, the flow rate of the primary fuel gas is regulated by the flow control valve 48 and it flows through the conduit 52 to the discharge nozzle 54 whereupon the primary fuel gas is discharged into the interior of the wall portion 38 where it mixes with air and the resulting fuel gas-air mixture is discharged into a primary combustion zone in the furnace to which the burner apparatus 10 is attached.

The combustion air with or without recirculated flue gases therein produced by the combustion air blower 24 flows into the interior of the housing 14 by way of the conduit 26 and the air inlet connection 22. While flowing through the housing 14, the combustion air is divided into primary air and secondary air portions. That is, a longitudinally aligned preferably cylindrical wall 56 is disposed within the housing 14 with the forward end 58 thereof sealingly attached over an opening 60 in the base portion 36 of the forward end 18 of the housing 14. The rearward end 62 of the wall 56 is partially closed by a primary air sleeve 64. The primary air sleeve 64 includes a cylindrical sleeve 66 which slidably fits within the cylindrical wall 56 and includes a plurality of openings 68 therein. A cover plate 70 is attached to the sleeve 66 which closes its external end. A position adjusting rod 72 or the equivalent is attached to the primary air sleeve 64 for moving it inwardly or outwardly to thereby adjust the flow rate of primary air which enters the interior of the wall 56.

As will now be understood, a primary air portion of the total combustion air entering the housing 14 flows through the openings 68 in the primary air sleeve 64, through the cylindrical wall 56, through the circular opening 60 in the base portion 36 and into the wall portion 38 of the housing 14. The flame retention plate 56 includes a plurality of openings 57 formed therein through which the primary air flows. The primary air flowing through the openings 57 mixes with the primary fuel gas discharged by way of the nozzle 54 to form a primary fuel gas-air mixture which is discharged into the previously mentioned primary burning zone in the furnace.

A second preferably cylindrical wall 74 which is of a larger diameter than the cylindrical wall 56 is positioned over the cylindrical wall 56 and sealingly attached to the base portion 36 of the housing 14. An annular end wall 76 is attached to the ends of the cylindrical walls 56 and 74 whereby an annular secondary fuel gas compartment 77 is formed between the walls 56 and 74. An inlet connection 78 is attached to a conduit 80 which sealingly passes through the housing 14 and is sealingly connected to an opening in the wall 74. A plurality of openings 82 are provided in the wall 74 near the opening or openings 44 in the base plate 36. A conduit 84 having a flow control valve 86 disposed therein is connected to a source of secondary fuel gas and to the connection 78. The secondary fuel gas flows through the conduit 80 into the annular compartment 77 between the cylindrical walls 56 and 74 and through the openings 82 into the space between the wall 74 and the housing 14.

The remaining combustion air flowing into the housing 14 that does not flow through the openings 68 in the primary air sleeve 64, i.e., the secondary air, also flows into the space between the wall 74 and the housing 14 wherein it mixes with the secondary fuel gas entering the space by way of the openings 82 in the wall 74. The resulting secondary fuel gas-air mixture flows through the openings 44 in the base portion 36 of the housing 14 outside of and adjacent to the wall 38 so that the secondary fuel gas-air mixture spreads over the exterior side 42 of the wall portion 38 and mixes with flue gases in the furnace before being ignited and burned as will be described further hereinbelow. The secondary fuel gas-air mixture is discharged from the opening or openings 44 over the wall portion 38 and into a secondary burning zone in the furnace to which the burner apparatus 10 is attached.

Referring now to FIG. 1 wherein the arrows formed with two dashes with a dot in between (–·→) represent combustion air, the arrows formed of solid lines (→) represent fuel gas and the arrows formed of dashed lines (– – →) represent flue gases in the furnace to which the burner 10 is attached, the operation of the burner apparatus 10 is described as follows. A controlled flow rate of combustion air with or without recirculated flue gases mixed therewith produced by the combustion air blower 24 is conducted by way of the conduit 26 to the burner apparatus 10. The combustion air enters the housing 14 of the burner apparatus 10 by way of the conduit 22 and is divided by the primary air sleeve 64 into primary air which flows through the flame retention plate 56 and secondary air which flows into the space between the wall 74 and the housing 14. Simultaneously a controlled flow rate of primary fuel gas flows from a source thereof into the conduit 52 which conducts the primary fuel gas to the nozzle 54 from where it is discharged into the interior of the wall portion 38. The primary fuel gas and primary air are mixed and the resulting primary fuel gas-air mixture is discharged from the wall portion 38 into a primary burning zone in the furnace to which the burner 10 is attached. Simultaneously a controlled flow rate of secondary fuel gas is conducted by way of the conduit 80 into the compartment 77 formed by the walls 56 and 74 within the housing 14 and through the openings 82 in the wall 74. The secondary fuel gas mixes with the secondary air in the space between the wall 74 and the housing 14 and the resulting secondary fuel gas-air mixture is discharged by way of the opening or openings 44 adjacent the exterior side 42 of the wall portion 38.

The size of the openings 44 through which the secondary fuel gas-air mixture is discharged and the flow rate of the secondary fuel gas-air mixture flowing through the openings 44 are such that the velocity of the secondary fuel gas-air mixture discharged adjacent to the external sides of the wall portion 38 exceeds the flame propagation speed of the mixture whereby the mixture is not ignited until after it spreads over the external side 42 of the wall portion 38, mixes with flue gases in the furnace space and flows beyond the wall portion 38. The non-burning mixture which flows between the openings 44 and the interior end of the wall portion 38 readily mixes with flue gases in the furnace which dilute the mixture and results in significantly lower $NO_x$ formation than is the case when the secondary fuel gas-air mixture ignites and burns immediately upon being discharged into the furnace.

Figure 3:
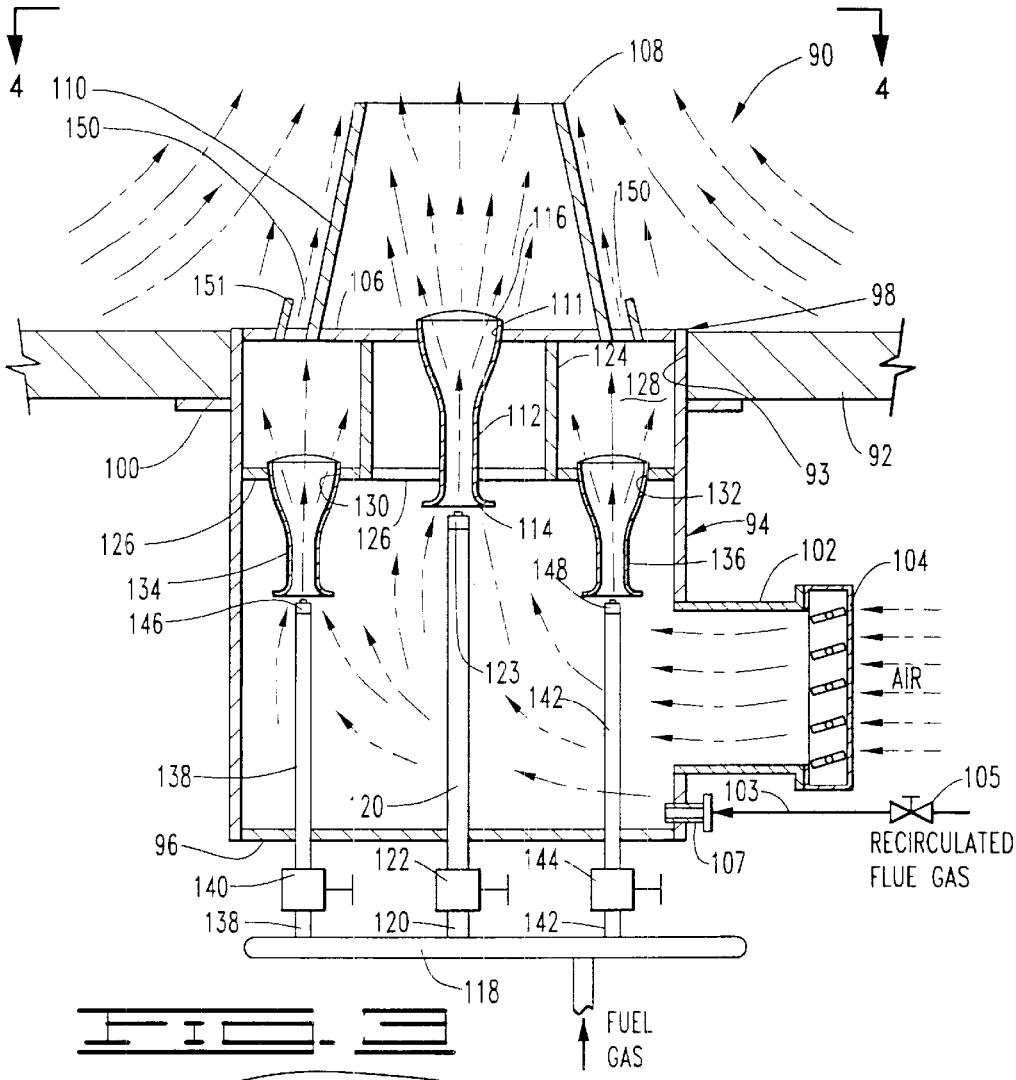
FIG. 3 is a partially schematic side cross-sectional view of another form of the burner apparatus of the present invention.
Figure 4:
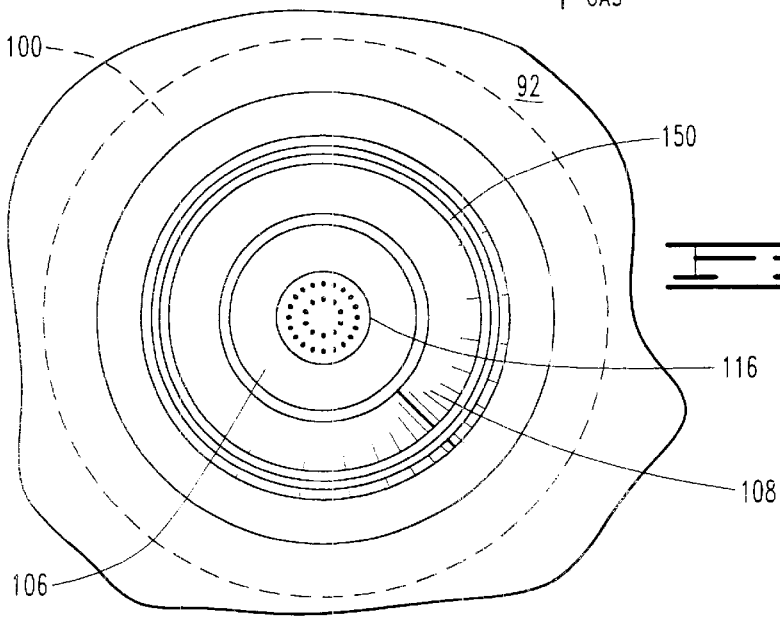
FIG. 4 is a view taken along line 4—4 of FIG. 3.

Referring now to FIGS. 3 and 4, an alternate embodiment of the burner apparatus of the present invention is illustrated and generally designated by the numeral 90. The burner apparatus 90 is similar to the burner apparatus 10 described above and operates in basically the same way. However, instead of an air blower to provide combustion air, the burner apparatus 90 utilizes venturi aspirators to draw the combustion air into the burner apparatus, to mix the primary and secondary fuel gas with combustion air and discharge the resulting fuel gas-air mixtures into the furnace to which the burner apparatus 90 is attached. The burner apparatus 90 is illustrated attached to the bottom wall 92 of a furnace over and within an opening 93 therein. The burner apparatus 90 is comprised of a housing 94 having a closed exterior or lower end 96 and a substantially closed interior or upper end 98. The housing 94 is attached to the furnace wall 92 by means of a flange 100 and a plurality of bolts (not shown). A combustion air inlet connection 102 is attached to the housing 94 and a conventional air control register 104 is attached to the connection 102. A recirculated flue gases conduit 103 having a flow control valve 105 therein can be connected to the furnace to which the burner apparatus 90 is attached or to a stack communicated with the furnace or to another source of flue gases and to an inlet connection 107 attached to the housing 94 whereby recirculated flue gases can be introduced into the housing 94. When introduced into the housing 94, the recirculated flue gases combine with the primary and secondary fuel gas-air mixtures produced by the venturi aspirators in the housing 94.

The upper end 98 of the housing 94 includes a base portion 106 and a wall portion 108 which extends into the furnace and surrounds a central area of the base portion 106. The exterior sides 110 of the wall portion 108 preferably slant towards the central area of the base portion 106. The central area of the base portion 106 inside the wall portion 108 includes an opening 111 therein. A venturi aspirator 112 having a fuel gas and air inlet 114 at one end and a primary fuel gas-air mixture discharge nozzle 116 at the other end is disposed within the opening 110 in the base portion 106. That is, the venturi aspirator 112 is connected in the opening 110 of the base portion 106 whereby the discharge nozzle end 116 is positioned to discharge fuel gas and air inside the wall portion 108 and the fuel gas and air inlet end 114 is within the housing 94.

A fuel gas header 118 is positioned outside the housing 94 adjacent to the lower end 96 thereof. A primary fuel gas conduit 120 connected to the header 118 having a primary fuel gas flow control valve 122 disposed therein extends through the end 96 of the housing 94 to a position adjacent the inlet end 114 of the venturi aspirator 112. A jet forming nozzle 123 is connected to the conduit 120 whereby a jet of primary fuel gas is produced within the venturi aspirator 112. The presence of the primary fuel gas jet within the venturi aspirator 112 causes primary air from within the housing 94 to be drawn into the venturi aspirator 112, mixed with the primary fuel gas therein and the resulting primary fuel gas-air mixture to be discharged into the inside of the wall portion 108 and into a primary fuel gas-air mixture burning zone in the furnace to which the burner apparatus 90 is connected.

A wall 124 which is preferably cylindrical is sealingly attached to the base portion 106 of the housing 94 inside the housing whereby it surrounds the venturi aspirator 112. An annular wall 126 is sealingly attached to the lower end of the wall 124 and to the side of the housing 94 whereby an annular compartment 128 is formed within the housing 94. In the embodiment illustrated in FIG. 3, a pair of openings 130 and 132 are formed in the annular wall 126 on opposite sides of the cylindrical wall 124. One or more venturi aspirators are sealingly attached to the wall 126 (two venturi aspirators 134 and 136 are shown in FIG. 3 sealingly disposed in the openings 130 and 132) with the discharge nozzles thereof extending into the annular compartment 128 and the fuel gas and air inlets thereof being within the housing 94 below the annular compartment 128. A secondary fuel gas conduit 138 having a secondary fuel gas flow control valve 140 disposed therein sealingly passes through the lower end 96 of the housing 94 and extends in the housing 94 to a point adjacent the inlet end of the venturi aspirator 134. In a like manner, a secondary fuel gas conduit 142 having a secondary fuel gas flow control valve 144 disposed therein sealingly extends through the lower end 96 of the housing 94 to a point adjacent the inlet end of the venturi aspirator 136. Jet forming nozzles 146 and 148 are attached to the conduits 138 and 142, respectively, so that secondary fuel gas is jetted into the venturi aspirators 134 and 136 which draw secondary combustion air therein. The secondary fuel gas and combustion air drawn into the venturi aspirators 134 and 136 are mixed therein and the secondary fuel gas-air mixtures are discharged from the venturi aspirators 134 and 136 into the annular compartment 128. One or more openings 150 or preferably a continuous annular opening 150 is provided in the base portion 106 outside of the wall portion 108 adjacent the exterior side 110 thereof. A deflector or deflectors 151 which function to direct the discharged secondary fuel gas-air mixture whereby it flows along and spreads over the exterior side 110 of the wall portion 108 are attached to the base portion 106 adjacent the opening or openings 150. As described above in connection with the burner apparatus 10, the secondary fuel gas-air mixture is discharged from the annular compartment 128 of the burner apparatus 90 by way of the opening or openings 150 into a secondary burning zone in the furnace to which the burner apparatus 90 is attached. The discharge of the secondary fuel gas-air mixture through the opening or openings 150 is at a velocity whereby the secondary fuel gas-air mixture is not ignited and burned until after the mixture spreads over the exterior side 110 of the wall portion 108, mixes with flue gases in the furnace and flows beyond the wall portion 108. As mentioned above, by not allowing the secondary fuel gas-air mixture to ignite during its passage along the exterior side 110 of the wall portion 108, flue gases in the furnace readily mix with the secondary fuel gas-air mixture whereby upon burning, the secondary fuel gas-air mixture produces lower $NO_x$ than when the secondary fuel gas-air mixture ignites immediately after being discharged into the furnace.

The arrows in FIG. 3 represent the same gases as described above in connection with FIG. 1 and the operation of the apparatus 90 is substantially the same as the operation of the burner apparatus 10 described above except the combustion air is drawn into the housing 94 by the operation of the venturi aspirators 112, 134 and 136 therein and the flow rates of the primary fuel gas and secondary fuel gas are controlled by the valves 122, 140 and 144, respectively.

Figure 5:
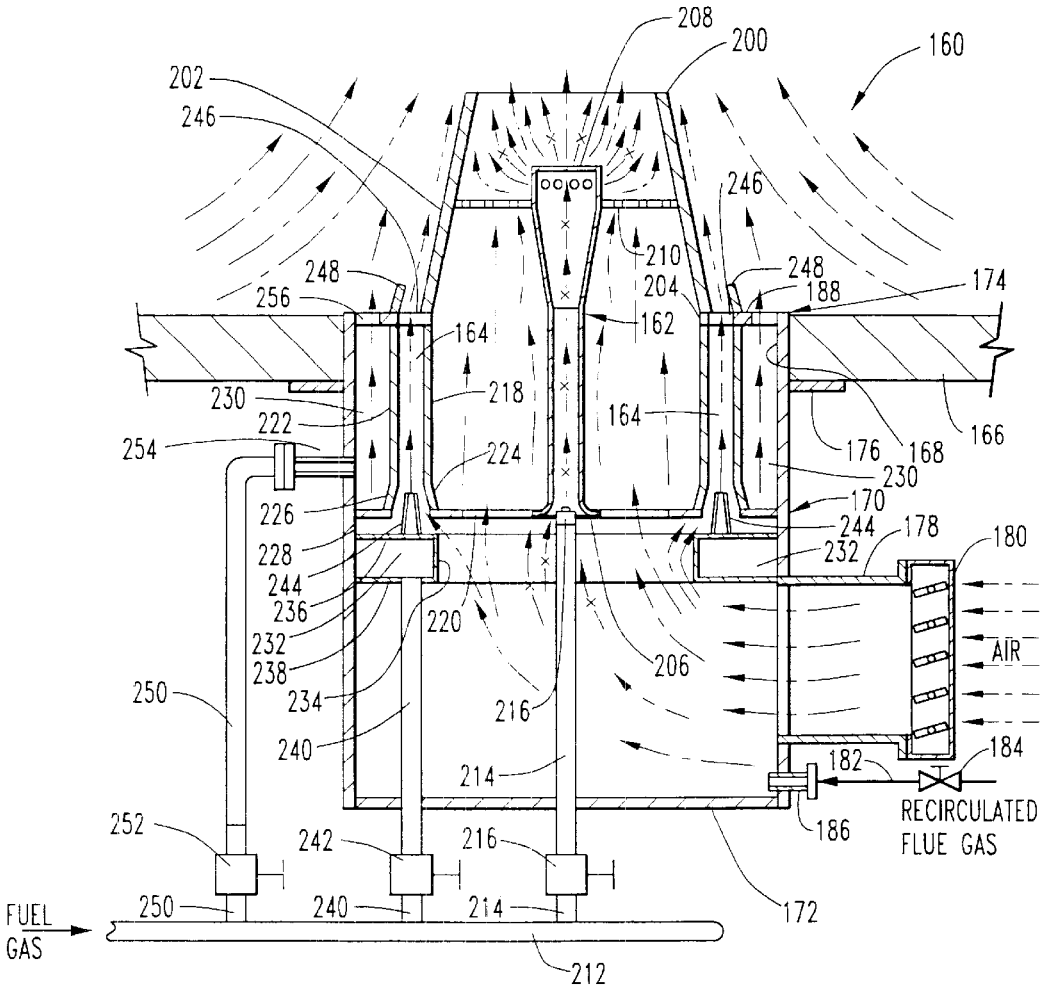
FIG. 5 is a partially schematic side cross-sectional view of yet another form of the burner apparatus of the present invention.
Figure 3:
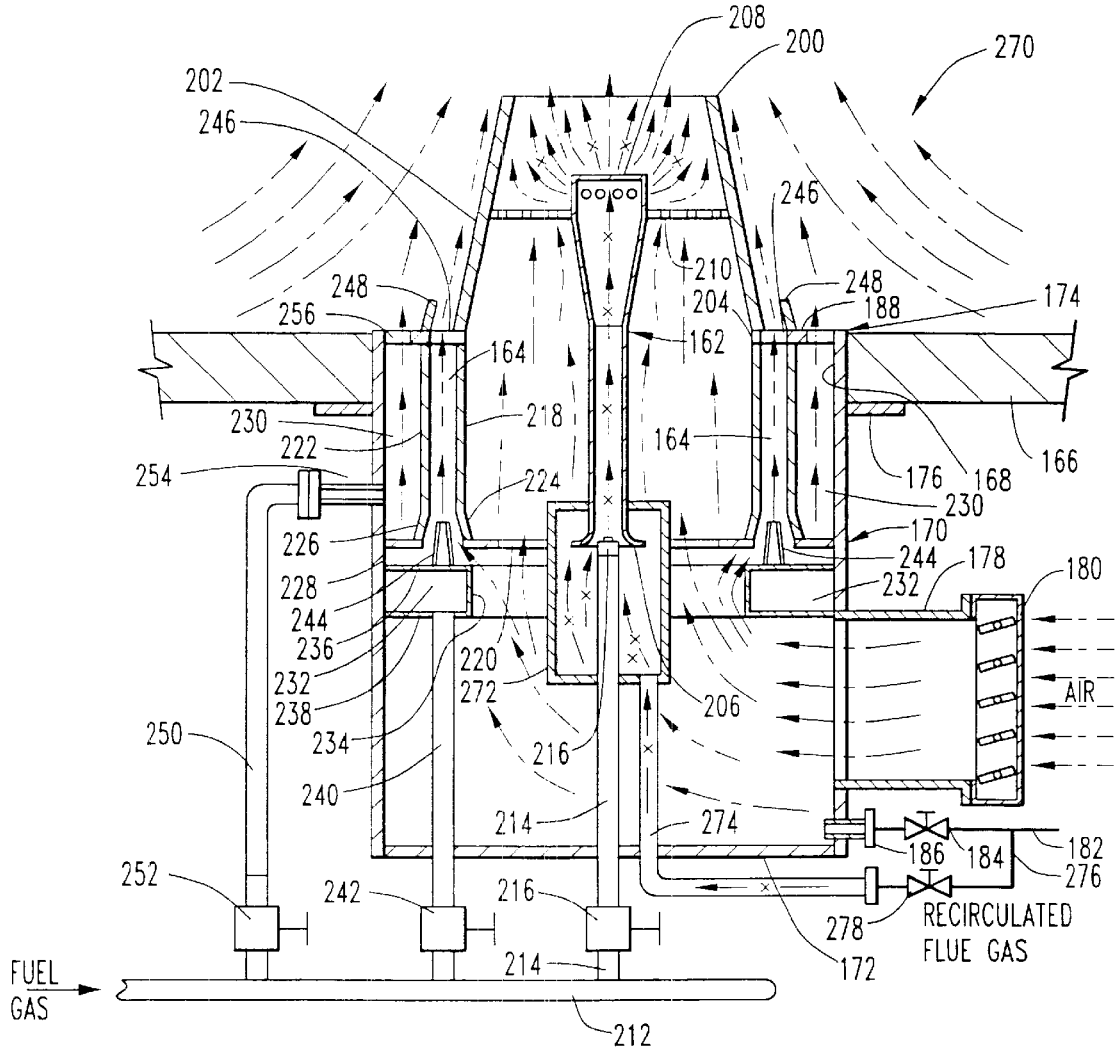

Referring now to FIG. 5, yet another alternate embodiment of the burner apparatus of the present invention is illustrated and generally designated by the numeral 160. The burner apparatus 160 is similar to the burner apparatus 90 described above and operates in basically the same way. That is, the burner apparatus 160 utilizes venturi aspirators to draw the combustion air into the burner apparatus, to mix the primary and secondary fuel gas with combustion air and discharge the resulting fuel gas-air mixtures into the furnace to which the burner apparatus 160 is attached. However, instead of two separate venturi aspirators, the burner apparatus 160 includes a primary centrally positioned venturi aspirator 162 and an annular secondary aspirator 164. In addition, the burner apparatus 160 includes means for discharging tertiary fuel gas into the furnace space as will be described in detail hereinbelow. The burner apparatus 160 is illustrated attached to the bottom wall 166 of a furnace over and within an opening 168 therein. The burner apparatus 160 is comprised of a housing 170 having a closed exterior or lower end 172 and a substantially closed interior or upper end 174. The housing 170 is attached to the furnace wall 166 by means of a flange 176 and a plurality of bolts (not shown). A combustion air inlet connection 178 is attached to the housing 170 and a conventional air control register 180 is attached to the connection 178. A recirculated flue gases conduit 182 having a flow control valve 184 therein can be connected to the furnace to which the burner apparatus 160 is attached or to a stack communicated with the furnace or to another source of flue gases and to an inlet connection 186 attached to the housing 94 whereby recirculated flue gases can be introduced into the housing 170. When introduced into the housing 170, the recirculated flue gases combined with the primary and secondary fuel gas-air mixtures produced in the housing 170.

The upper end 174 of the housing 170 includes a base portion 188 and a wall portion 200 which extends into the furnace and surrounds a central area of the base portion 188. The exterior sides 202 of the wall portion 200 preferably slant towards the interior of the base portion 188. The central area of the base portion 188 inside the wall portion 202 is open, i.e., the wall portion 200 is attached over an opening 204 in the base portion 188.

The venturi aspirator 162 includes a fuel gas and air inlet 206 at one end and a primary fuel gas-air mixture discharge nozzle 208 at the other end and is disposed within the opening 204 in the base portion 188. That is, the venturi aspirator 162 is disposed centrally within the opening 204 of the base portion 188 by a perforated flame holder 210 attached thereto and to the interior of the wall portion 200. Thus, the discharge nozzle end 208 of the venturi aspirator 162 is positioned within the wall portion 200 and the fuel gas and air inlet end 206 is positioned within the housing 170.

A fuel gas header 212 is positioned outside the housing 170 adjacent to the lower end 172 thereof. A primary fuel gas conduit 214 connected to the header 212 having a primary fuel gas flow control valve 216 disposed therein extends through the end 172 of the housing 170 to a position adjacent the inlet end 206 of the venturi aspirator 162. A jet forming nozzle 216 is connected to the conduit 214 whereby a jet of primary fuel gas is produced within the venturi aspirator 162. The presence of the primary fuel gas jet within the venturi aspirator 162 causes primary air from within the housing 170 to be drawn into the venturi aspirator 162, mixed with the primary fuel gas therein and the resulting primary fuel gas-air mixture to be discharged into the inside of the wall portion 200 and into a primary fuel gas-air mixture burning zone in the furnace to which the burner apparatus 160 is connected.

A wall 218 which is preferably cylindrical is sealingly attached to the base portion 188 of the housing 170 inside the housing whereby it surrounds the venturi aspirator 162 and has an opening 220 in the bottom end thereof. A second wall 222 which is also preferably cylindrical and is larger than the wall 218 is attached to the base portion 188 whereby an annular venturi aspirator 164 is formed between the walls 218 and 222. Both the walls 218 and 222 have outwardly slanted portions 224 and 226, respectively, at their lower ends whereby the bottom portion of the annular venturi aspirator 164 is flared. An annular bottom wall 228 is sealingly attached to the lower end of the wall 222 and to the side of the housing 170 whereby an annular compartment 230 is formed within the housing 170. An annular compartment 232 formed of an annular side 234, an annular top 236 and an annular bottom 238 is sealingly attached to the inside of the housing 170 whereby it is positioned below the annular venturi aspirator 164. A secondary fuel gas conduit 240 having a secondary fuel gas flow control valve 242 disposed therein is connected to the header 212, sealingly passes through the lower end 172 of the housing 170 and is sealingly connected to an opening in the annular compartment 232. A plurality of fuel gas nozzles 244 (two are shown in FIG. 5) are sealingly attached to spaced openings in the top 236 of the annular compartment 232 and extend into the bottom flared portion of the annular venturi aspirator 164.

Secondary fuel gas from the header 212 flows through the conduit 240 and the control valve 242 into the annular compartment 236 and through the jet forming nozzles 244 into the annular venturi 164. The secondary fuel gas and combustion air drawn into the annular venturi aspirator 164 are mixed therein and the secondary fuel gas-air mixture is discharged from the annular venturi aspirator 164 by way of an annular opening 246 in the base portion 188 of the housing 170 adjacent to the exterior of the wall portion 200 thereof. An annular deflector 248 which functions to direct the fuel gas-air mixture formed in the annular venturi aspirator 164 and discharged therefrom by way of the annular opening 246 whereby it flows along and spreads over the exterior sides 202 of the wall portion 200 is attached to the base portion 188 adjacent to the annular opening 246. As described above in connection with the apparatus 10 and 90, the secondary fuel gas-air mixture is discharged from the annular venturi aspirator 164 by way of the annular opening 246 into a secondary burning zone in the furnace to which the burner 160 is attached. The discharge of the secondary fuel gas-air mixture through the opening 246 is at a velocity whereby the secondary fuel gas-air mixture is not ignited and burned until after the mixture spreads over the exterior sides 202 of the wall portion 200, mixes with flue gases in the furnace and flows beyond the wall portion 200. As stated above, by not allowing the secondary fuel gas-air mixture to ignite during its passage along the exterior sides 202 of the wall portion 200, flue gases in the furnace readily mix with the secondary fuel gas-air mixture whereby upon burning, the secondary fuel gas-air mixture produces lower $NO_x$ than when the secondary fuel gas-air mixture ignites immediately after being discharged into the furnace.

A fuel gas conduit 250 having a fuel gas flow control valve 252 disposed therein is connected to an inlet connection 254 attached to the housing 170 and opening into the annular compartment 230 therein. An annular opening is disposed in the base portion 188 of the housing 170 which communicates with the annular compartment 230. A third portion of the fuel gas from the header 212 flows into the annular compartment 230 by way of the conduit 250, the valve 252 and the connection 254 and is discharged therefrom by way of the annular opening 256 in the base portion 188 into a tertiary burning zone in the furnace to which the burner apparatus 160 is connected.

The arrows in FIG. 5 represent the same gases as described above in connection with FIGS. 1 and 3, and the operation of the burner apparatus 160 is substantially the same as the operation of the burner apparatus 90 described above except that the apparatus 160 includes an annular venturi aspirator 164 instead of two individual secondary fuel gas-air venturi aspirators and means for discharging a third portion of fuel gas into a tertiary burning zone in the furnace.

Referring now to FIG. 6, yet another alternate embodiment of the burner apparatus of the present invention is illustrated and generally designated by the numeral 270. The burner apparatus 270 is exactly the same as the burner apparatus 160 illustrated in FIG. 5 and described above except for a modification which allows recirculated flue gases to be mixed with the primary fuel gas and air which is discharged into the primary burning zone in the furnace. In FIG. 6, the reference numerals are the same as those utilized in FIG. 5 and designate the same parts as in FIG. 5. The only new reference numerals utilized in FIG. 6 are the numeral 270 which generally designate the burner apparatus shown in FIG. 6 and the reference numerals 272 through 278 which identify the modification in the burner apparatus which brings about the mixing of recirculated flue gases with the primary fuel gas. More specifically, a closed compartment 272 is sealingly attached to the lower end portion of the venturi aspirator 162 and to the primary fuel gas conduit 214. A conduit 274 which passes through the bottom end 172 of the housing 170 is sealingly attached to the closed compartment 272 for introducing recirculated flue gases into the closed compartment 272. A conduit 276 having a control valve 278 disposed therein is connected to the conduit 182 which is in turn connected to a source of recirculated flue gases.

The operation of the burner apparatus 270 is identical to the operation of the burner apparatus 160 described above except that the venturi apparatus 162 produces a mixture of primary fuel gas and recirculated flue gases instead of a mixture of primary fuel gas and air as described above relating to the burner apparatus 160. Recirculated flue gases flowing to the burner apparatus 270 by way of the conduit 182 flow through the conduit 276, through the control valve 278 and through the conduit 274 into the closed compartment 272. As shown by the arrows which have an x in the middle, the recirculated flue gases are drawn from the closed compartment 272 into the venturi aspirator 162 by the fuel gas jet produced within the venturi aspirator 162 by the fuel gas nozzle 216. The resulting fuel gas-recirculated flue gases mixture flows through the venturi aspirator 162 and is discharged therefrom by way of the nozzle 208 thereof. The primary fuel gas-recirculated flue gas discharged from the nozzle 208 mixes with the primary air flowing through the flame holder 210 to form a primary fuel gas-recirculated flue gas-air mixture which is discharged into the primary burning zone in the furnace to which the burner apparatus of FIG. 6 is attached.

In operation of the burner apparatus 10, 90, 160 and 270 of this invention, the primary, secondary and tertiary (when used) fuel flow control valves and the air flow control registers are set whereby the total of the fuel gas and air mixtures introduced into the furnace is a substantially stoichiometric mixture of fuel gas and air. Generally, the fuel gas used to form the primary fuel gas-air mixture in the burner apparatus 10, 90, 160 and 270 is in the range of from about 5% to about 50% by volume of the total fuel gas discharged into the furnace. The portion of the air used to form the primary fuel gas-air mixture is in the range of from about 3% to about 60% by volume of the total air discharged into the furnace.

The fuel gas utilized in the burner apparatus 10 or 90 can be hydrogen, a light hydrocarbon gas such as methane or a mixture of light hydrocarbon gases such as natural gas. The air can be atmospheric air or atmospheric air enriched with oxygen.

As will be understood by those skilled in the art, the burner apparatus 10, 90, 160 and 270 preferably also include a pilot light assembly connected to a source of fuel gas, a pilot light igniter, a flame scanner for monitoring and adjusting the flame and other similar standard burner accessories which are not shown in the drawings. Also, the ends of the housings of the burner apparatus which extend into the furnace openings can be formed of metal as illustrated in the drawings or they can be formed of a ceramic material or the like.

Thus, the methods of the present invention for discharging a substantially stoichiometric mixture of fuel gas and air into a furnace wherein the mixture is burned and flue gases having a low $NO_x$ content are formed therefrom are basically comprised of the steps of: (a) mixing a first portion of the fuel gas with a first portion of the air to form a primary fuel gas-air mixture; (b) discharging the primary fuel gas-air mixture into a primary burning zone in the furnace from at least one primary fuel gas-air mixture discharge location surrounded by a wall which extends into the furnace; (c) mixing a second portion of the fuel gas and a second portion of the air to form a secondary fuel gas-air mixture; and (d) discharging the secondary fuel gas-air mixture into a secondary burning zone in the furnace from at least one secondary fuel gas-air mixture discharge location adjacent to an exterior side of the wall at a velocity whereby the secondary fuel gas-air mixture is not ignited and burned until the mixture spreads over the exterior side of the wall, mixes with flue gases in the furnace and flows beyond the wall.

The primary fuel gas-air mixture and the secondary fuel gas-air mixture can be formed in steps (a) and (c) by jetting the portions of the fuel gas into streams of air produced by an air blower. Alternatively, the primary fuel gas-air mixture and the secondary fuel gas-air mixture can be formed in steps (a) and (c) by jetting the portions of the primary and secondary fuel gas into the inlet ends of venturi aspirators having discharge nozzles or openings at the other ends positioned at the primary and secondary fuel gas-air mixture discharge locations whereby air is drawn into the venturi aspirators, mixed with the fuel gas therein and discharged therefrom. Recirculated flue gases can be combined with the first portion of the fuel gas or with the first and second portions of the air or with both the first portion of the fuel gas and the first and second portions of the air as desired.

The burner apparatus for discharging a substantially stoichiometric mixture of fuel gas and air into a furnace wherein the mixture is burned and flue gases having low $NO_x$ content are formed therefrom basically comprises: a burner housing attached to the furnace and having a forward end which includes a base portion and a wall portion, the wall portion extending into the furnace and surrounding a central area of the base portion; means connected to the housing for mixing a first portion of the fuel gas with a first portion of the air to form a primary fuel gas-air mixture and discharging the primary fuel gas-air mixture into a primary burning zone in the furnace from at least one primary fuel gas-air mixture discharge location within the space defined by the central area of the base portion and the interior of the wall portion of the burner housing; and means connected to the housing for mixing a second portion of the fuel gas with a second portion of the air to form a secondary fuel gas-air mixture and discharging the secondary fuel gas-air mixture into a secondary burning zone in the furnace from at least one secondary fuel gas-air mixture discharge location adjacent to an exterior side of the wall portion at a velocity whereby the secondary fuel gas-air mixture is not ignited and burned until the mixture spreads over the exterior side of the wall portion, mixes with flue gases in the furnace and flows beyond the wall portion.

As mentioned above, the secondary fuel gas-air mixture is not ignited by the burning fuel gas-air mixtures in the furnace until it spreads over the exterior side of the wall portion of the burner housing, mixes with flue gases in the furnace and flows beyond the wall portion. Upon flowing beyond the wall portion of the housing, the secondary fuel gas-air mixture is ignited and a flame known in the art as a "lifted pre-mix flame" is produced. The secondary fuel gas-air mixture is a fuel gas lean mixture and prior to ignition, the lean mixture is in contact with flue gases in the furnace. As a result, large quantities of flue gases are entrained in the secondary fuel gas-air mixture which produces a fuel gas leaner mixture. When the fuel gas lean secondary fuel gas-air-flue gases mixture is burned in the secondary burning zone in the furnace it produces flue gases having very low $NO_x$ content and when mixed with the flue gases produced by the primary fuel gas-air mixture burned in the primary burning zone, the combined flue gases have a very low $NO_x$ content as compared to similar burner apparatus which do not include a lean secondary fuel gas-air mixture which mixes with large quantities of flue gases in the furnace before producing a stable lifted premix flame therein.

Thus, the present invention is well adapted to carry out the objects and attain the ends and advantages mentioned as well as those which are inherent therein. While numerous changes in the burner apparatus and methods of the present invention may be made by those skilled in the art, such changes are encompassed within the spirit of this invention as defined by the appended claims.

What is claimed is:

1. An improved burner apparatus for discharging a substantially stoichiometric mixture of fuel gas and air into a furnace wherein the mixture is burned and flue gases having low $NO_x$ content are formed therefrom comprising:

a burner housing attached to said furnace having a forward end which includes a base portion and a wall portion, the wall portion extending into said furnace and surrounding a central area of said base portion;

means connected to said housing for mixing a first portion of said fuel gas with a first portion of said air to form a primary fuel gas-air mixture and discharging said primary fuel gas-air mixture into a primary burning zone in said furnace from at least one primary fuel gas-air mixture discharge location within the space defined by said central area of said base portion and the interior of said wall portion of said burner housing; and means connected to said housing for mixing a second portion of said fuel gas with a second portion of said air to form a secondary fuel gas-air mixture and discharging said secondary fuel gas-air mixture into a secondary burning zone in said furnace from at least one secondary fuel gas-air mixture discharge location adjacent to an exterior side of said wall portion at a velocity whereby said secondary fuel gas-air mixture is not ignited and burned until said mixture spreads over said exterior side of said wall portion, mixes with flue gases in said furnace and flows beyond said wall portion.

2. The burner apparatus of claim 1 wherein said means connected to said housing for mixing said first portion of said fuel gas with said first portion of said air to form said primary fuel gas-air mixture and discharging said mixture into said primary burning zone in said furnace comprise:

said base portion of said forward end of said housing inside said wall including at least one opening formed therein whereby said first portion of said air is discharged from within said housing through said opening; and at least one fuel gas nozzle positioned to discharge said first portion of said fuel gas into said first portion of said air to thereby form said primary fuel gas-air mixture and discharge said mixture from said primary fuel gas-air mixture discharge location into said primary burning zone.

3. The burner apparatus of claim 2 which further comprises an air blower or the equivalent for providing said first portion of said air within said housing.

4. The burner apparatus of claim 3 which further comprises means attached to said air blower for mixing recirculated flue gases with said air provided within said housing.

5. The burner apparatus of claim 1 wherein said means connected to said housing for mixing said second portion of said fuel gas with said second portion of said air to form said secondary fuel gas-air mixture and discharging said mixture into said secondary burning zone in said furnace space comprise:

said base portion of said forward end of said housing outside of said wall including at least one discharge opening formed therein for discharging said secondary fuel gas-air mixture from within said housing into said secondary burning zone; and at least one fuel gas opening positioned within said housing in communication with a source of said second portion of said fuel gas for discharging said second portion of said fuel gas into said second portion of said air flowing through said housing to thereby form said secondary fuel gas-air mixture which is discharged through said discharge opening in said base portion of said housing.

6. The burner apparatus of claim 5 which further comprises an air blower or the equivalent for providing said second portion of said air within said housing.

7. The burner apparatus of claim 6 which further comprises means attached to said air blower for mixing recirculated flue gases with said air provided within said housing.

8. The burner apparatus of claim 1 wherein said means connected to said housing for mixing said first portion of said fuel gas with said first portion of said air to form said primary fuel gas-air mixture and discharging said mixture into said primary burning zone in said furnace comprise:

said base portion of said forward end of said housing inside said wall portion including at least one opening therein;

at least one venturi aspirator having a fuel gas and air inlet at one end and a primary fuel gas-air mixture discharge nozzle at the other end disposed in said opening with said discharge nozzle thereof inside said wall portion and with said fuel gas and air inlet thereof within said housing; and a fuel gas jet forming nozzle adapted to be connected to a source of said first portion of said fuel gas positioned to jet said first portion of said fuel gas into said venturi aspirator by way of said inlet end thereof whereby said first portion of said air is drawn into said venturi aspirator, mixed with said first portion of said fuel gas and the resulting primary fuel gas-air mixture is discharged into said primary burning zone in said furnace.

9. The burner apparatus of claim 8 wherein said housing further comprises an air register attached thereto for regulating the rate of air drawn into said venturi aspirator.

10. The burner apparatus of claim 8 which further comprises means connected to said housing for mixing recirculated flue gases with said first portion of said air.

11. The burner apparatus of claim 1 wherein said means connected to said housing for mixing said second portion of said fuel gas with said second portion of said air to form said secondary fuel gas-air mixture and discharging said mixture into said secondary burning zone in said furnace comprises:

said base portion of said forward end of said housing outside of said wall portion including at least one secondary fuel gas-air mixture discharge opening formed therein;

at least one venturi aspirator having a fuel gas and air inlet at one end and a secondary fuel gas-air mixture discharge nozzle at the other end disposed within said housing with said discharge nozzle thereof in communication with said opening; and at least one fuel gas jet forming nozzle adapted to be connected to a source of said second portion of said fuel gas positioned to jet said second portion of said fuel gas into said venturi aspirator by way of said inlet end thereof whereby said second portion of said air is drawn into said venturi aspirator, mixed with said second portion of said fuel gas and the resulting secondary fuel gas-air mixture is discharged into said secondary burning zone in said furnace.

12. The burner apparatus of claim 11 wherein said housing further comprises an air register attached thereto for regulating the rate of air drawn into said venturi aspirator.

13. The burner apparatus of claim 11 which further comprises means connected to said housing for mixing recirculated flue gases with said second portion of said air.

14. The burner apparatus of claim 1 which further comprises means connected to said housing for mixing recirculated flue gases with said primary fuel gas-air mixture discharged into said primary burning zone.

15. The burner apparatus of claim 1 which further comprises means for discharging a third portion of said fuel gas into a tertiary burning zone in said furnace from at least one third fuel gas discharge location adjacent to said secondary fuel gas-air mixture discharge location.

* * * * *